United States Patent [19]

Thomas et al.

[11] 4,252,473

[45] Feb. 24, 1981

[54] COMPOSITE PILE AND METHOD OF MANUFACTURE

[75] Inventors: Albert M. Thomas, North Canton, Ohio; Earl E. Seck, Marietta, Ga.

[73] Assignee: Republic Steel Corporation, Cleveland, Ohio

[21] Appl. No.: 937,337

[22] Filed: Aug. 28, 1978

[51] Int. Cl.[3] ..... E02D 5/48

[52] U.S. Cl. ..... 405/250; 52/726; 405/251

[58] Field of Search ..... 405/250, 251, 252; 52/725, 726, 727, 728; 403/280, 282, 283, 292

[56] References Cited

U.S. PATENT DOCUMENTS

| | | | |
|---|---|---|---|
| 1,865,657 | 7/1932 | Watt et al. | 405/250 |
| 1,916,702 | 7/1933 | Watt | 405/250 X |
| 2,168,459 | 8/1939 | Upson | 405/250 |
| 2,200,524 | 5/1940 | Watt | 405/250 |
| 2,558,529 | 6/1951 | Thornley | 405/250 X |
| 2,701,449 | 2/1955 | Young | 405/250 |
| 2,782,606 | 2/1957 | Fox | 405/250 |
| 2,821,069 | 1/1958 | Fox | 405/250 |
| 2,874,546 | 2/1959 | Fox | 405/250 |
| 2,912,829 | 11/1959 | Cobi | 405/250 |
| 2,932,952 | 4/1960 | Fox | 405/250 |
| 2,938,355 | 5/1960 | Dougherty | 405/250 |
| 3,003,323 | 10/1961 | Holt | 405/251 |
| 3,218,813 | 11/1965 | Fiore | 405/254 |
| 3,543,524 | 12/1970 | Clements | 405/255 |

*Primary Examiner*—David H. Corbin

*Attorney, Agent, or Firm*—Watts, Hoffmann, Fisher & Heinke, Co.

[57] ABSTRACT

A composite pile includes a wooden section and a helically corrugated shell secured to the wooden section by a transition fitting. The transition fitting is fitted telescopically to a tubular end portion of the shell by a circumferential weld which is embedded in the wooden section. Because the weld is very strong and is disposed within the wooden section, the strength of transition-to-shell connection is increased over prior composite piles. The pile manufacture includes the step of removing corrugations from the end of a shell by squeezing the end of the shell between radially movable, annular die segments.

12 Claims, 6 Drawing Figures

COMPOSITE PILE AND METHOD OF MANUFACTURE

BACKGROUND OF THE INVENTION

1. Field of the Invention

The invention relates to composite piles and, more particularly, to a composite pile in which a transition fitting is fitted telescopically to the end of a shell.

2. Description of the Prior Art

A typical composite pile includes a wooden section driven deep into the earth and a tubular steel shell secured to the top of the wooden section. The tubular shell extends upwardly to the vicinity of the surface of the earth. The shell is filled with concrete to provide an assembly which provides support on which a building or other structure may be assembled.

There are at least two types of composite piles. One type uses corrugated steel shells while another uses smooth-walled pipe as a form for the concrete. In many applications a corrugated shell is preferred, if for no other reason, because of cost.

A problem in prior corrugated type composite piles is the manner in which the corrugated shell is secured to the wooden section. In most piles, a so-called transition fitting is secured to one end of the shell, such as by butt welding the end of the shell to an annular plate at or near the top of the transition fitting. The transition fitting is driven into the wooden section after the wooden section itself has been driven to a point where the top of the wooden section is at or near ground level. Repeated blows from the driving mechanism force the wooden section and the now-attached shell into the earth to the desired depth.

Since the corrugated shell has relatively little compressive strength, the pile is driven with an elongated mandrel that acts against the transition fitting and the wood section. Thus, the corrugated shell is literally pulled into the earth through its connection to the transition fitting. In prior corrugated shell composite piles, this connection has been accomplished by a weld connection between the transition fitting and the shell at a location above the pile. Since there are tremendous frictional forces between the shell and the surrounding earth, substantial tensile forces are imposed on the weld. In addition, the frictional forces tend to elongate the relatively thin-walled shell and this elongation tends to reduce the diameter of the shell. This size reduction causes a shear force to be applied to the weld as well as the tensile force.

Unless the weld is substantially perfect, there is a great potential for weld failure and as a consequence for a failure to construct a satisfactory pile because the wood and transition fitting will separate from the shell. While there has been a proposal to use a smooth walled pipe in a tenon arrangement, and to drive the shell along with a transition fitting into the piling, the corrugated shell itself has in the past always been connected to a transition fitting with an exposed weld above the wood pile.

SUMMARY OF THE INVENTION

The present invention provides a simple, effective technique for joining a shell to a wooden section in a composite pile. Essentially, the composite pile according to the invention includes a wooden section having an upper surface disposed generally horizontally and a corrugated shell for receiving concrete. The shell is mounted to the upper surface of the wooden section by a transition fitting telescopically fitted to the end of the shell and secured there by a weld located at the interface between the transition fitting and the shell.

The transition fitting is in the shape of a solid of revolution and includes at least one drive wedge extending across and secured to the inner diameter of the transition fitting. The drive wedges are adapted to be engaged by a driving mechanism so that the transition fitting, and with it the end of the shell, are driven into the end of the wooden section.

The disclosed shell includes corrugations forming a major portion of the shell and a tubular, uncorrugated end portion integral with the corrugated portion. The transition fitting is nested telescopically in the uncorrugated end portion. If desired, the inside diameter of the tubular end portion may be chosen to be no greater than the diameter of an imaginary surface of revolution defined by the innermost surfaces of the shell. This construction permits a larger shell to be used with a given-sized wooden section than otherwise would be possible.

For maximum strength, the transition fitting is nested at least partially within the tubular end portion. The weld securing the transition fitting to the shell is disposed at a circumferential interface between the fitting and the end of the shell. With this construction, the weld is embedded in the wooden section during the driving process.

Preferably, the transition fitting is a solid of revolution in the form of a thin-walled ring. The drive wedges also are relatively thin to facilitate driving them into the wooden section. Each drive wedge preferably includes a plate member welded at its end to the inner surface of the ring, the largest surface of the plate member lying in a plane disposed parallel to the longitudinal axis of the shell.

Because the weld connecting the transition fitting to the shell, and most, if not all, of the transition fitting are driven into the wooden section, failure-prone portions of the composite pile are buried in the wood and, consequently, the strength of the composite pile is improved. Lateral forces which result from shell elongation and shrinkage are absorbed above the wood pile and isolated from the weld. Accordingly, the weld is subjected essentially only to tensile, and not shear, forces. The substantial surface-to-surface engagement between the transition fitting, shell, and wooden section provides an increased frictional force between the various components which absorbs some of the tensile force resulting from the driving process. Accordingly, not only are the forces applied to the weld essentially only tensile, but in addition those tensile forces are reduced.

A further advantage over many prior constructions is that a good weld is more easily formed. The weld is between an outer wall, preferably cylindrical, of the transition fitting and the end of a nested shell end portion as contrasted with a weld between the end of a helical shell and an annular, transversely disposed, plate.

Accordingly, the object of the invention is to provide a novel and improved corrugated piling including a novel and improved transition fitting, a fitting-to-shell connection and a process of making composite pilings.

Other objects and a fuller understanding of the invention may be had by referring to the following description and claims taken in conjunction with the accompanying drawings.

DESCRIPTION OF THE PREFERRED EMBODIMENT

Figure 1:
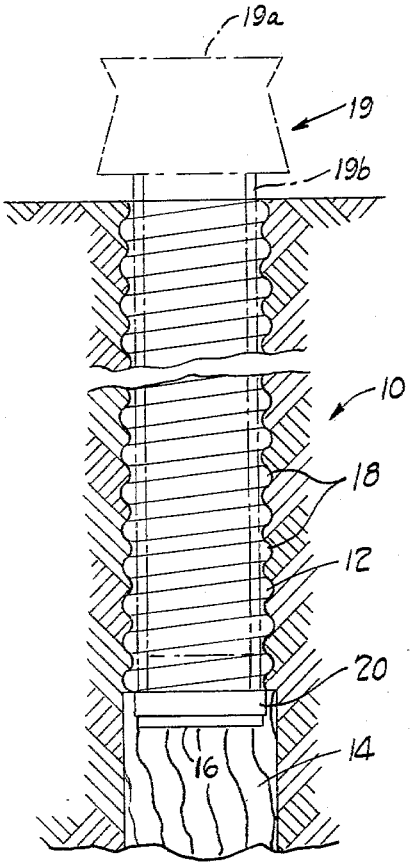
FIG. 1 is a profile view of a composite pile according to the invention driven into the earth, with the top of the shell flush with the surface of the earth.

A composite pile 10 according to the invention is shown in FIG. 1. The pile comprises a tubular metal shell 12, a wooden section 14, and a transition fitting 16. The shell is formed of steel which is typically of 8 to 20 gauge and which has helical corrugations 18 along a major portion of its length. A drive mechanism 19, having a driving head 19*a* and a follower 19*b*, is employed to drive the transition fitting (and the end of the shell) into the wooden section when the top of the wooden section is at or near ground level. The drive mechanism then is used to drive the composite structure into the earth to a desired depth.

One end of the shell has had the corrugations removed to provide a tubular end portion 20 integral with the rest of the shell. The corrugations are removed by a technique wherein the end of the shell is compressed between radially movable, annular die segments to produce an end portion of accurately controlled diameter.

Figure 6:
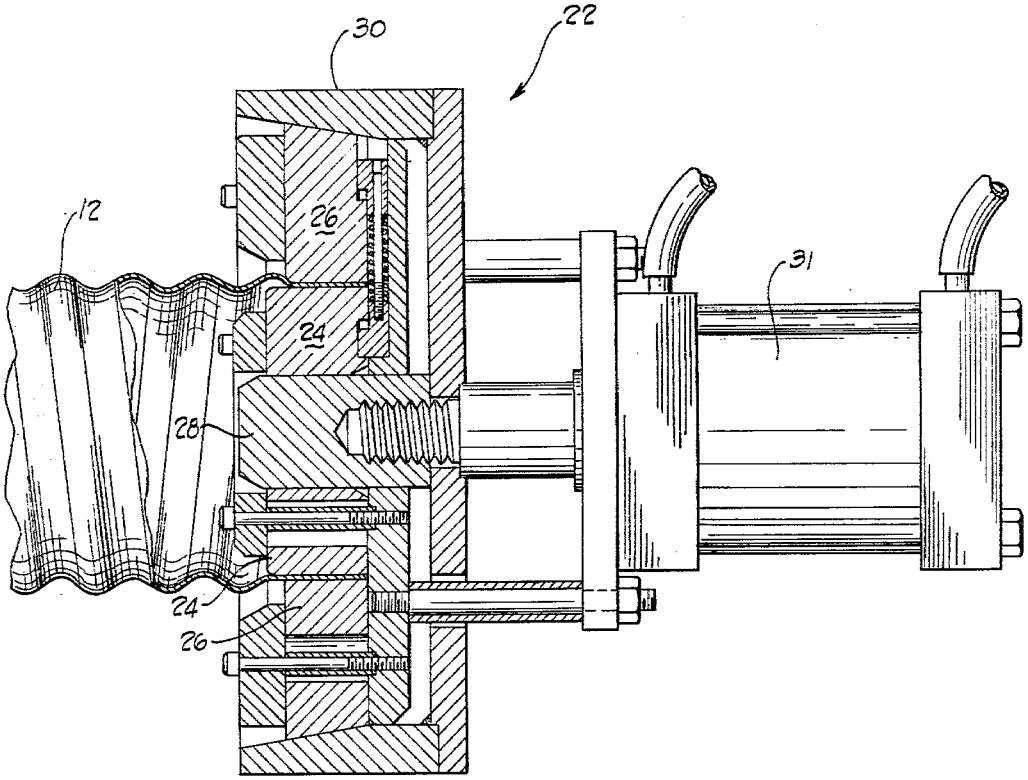

In FIG. 6, a machine 22 suitable for removing corrugations from the end of a shell is shown. The machine 22 includes segmented annular dies 24, 26 between which the end of a shell is squeezed. The dies 24, 26 are actuated by inner and outer cams 28, 30, respectively, which in turn are acted upon by a hydraulic cylinder 31. Reference is made to application Ser. No. 937,429 entitled "Helically Corrugated Pipe and Method for Removing Certain of the Corrugations," filed concurrently by A. M. Thomas and owned by the assignee of this invention, for additional details of a preferred machine and method to remove corrugations from the end of the shell 12.

The diameter of the end portion 20 can be made larger, smaller, or intermediate the diameter of imaginary cylinders defined by (a) a surface of revolution contacting the innermost surfaces of the shell; and (b) a surface of revolution contacting the outermost surfaces of the shell.

The transition fitting 16 includes a solid of revolution in the form of a thin-walled ring 32 whose cross-section is a generally rectangular area having its longest dimension extending axially of the shell. This means that the transition fitting can be driven into the wood with a minimum resistance and yet provide sufficient strength to withstand forces imposed during the driving process.

The transition fitting 16 also includes drive wedges 34 secured at their ends to the inner surface of the ring 32 by welds 36. In the embodiment illustrated, two drive wedges 34 are provided. These drive wedges are crossed at 90° and secured there against displacement by additional welds 38 at the crossing. The largest surface of the drive wedge lies in a plane disposed parallel to the longitudinal axis of the shell to minimize resistance to being embedded in the wooden section and to provide the greatest strength in planes in which pile driving forces are applied. Taken together, the ring, the drive wedges, and the shell are in surface-to-surface contact with a substantial internal portion of the wooden section so that considerable frictional forces tend to hold the assembly together during the driving process.

Figure 5:
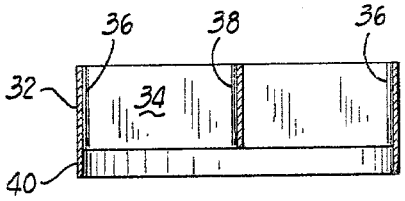
FIG. 5 is a sectional view of the transition fitting as seen from the plane indicated by the line 5—5 of FIG. 4; and, FIG. 6 is a view, partly in section, of a machine suitable for removing corrugations from the end of a shell.

As shown in FIG. 5, the drive wedges 34 do not extend the full wall height of the ring 32. Rather, the wedges have a dimension having an extent, axially of the shell, equal to the axial extent of telescopic relationship of the shell and transition. A lower portion 40 of the ring projects below both the wedges and the shell for two reasons. These reasons are: (a) the lower portion facilitates initial wooden pile penetration; and (b) it facilitates the formation of a strong weld 42.

Figure 2:
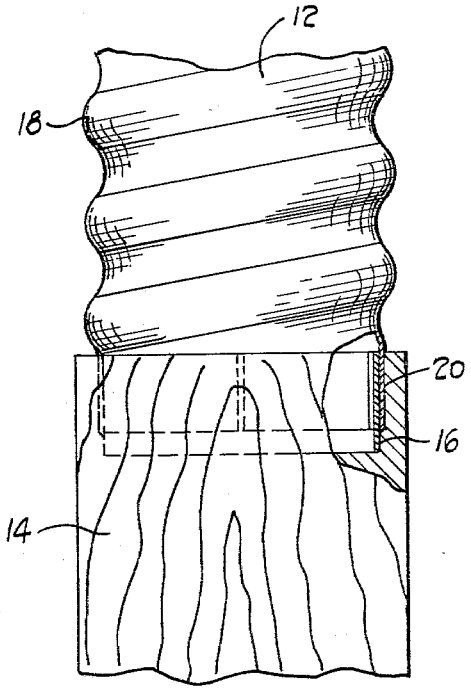
FIG. 2 is a fragmentary, enlarged, elevational view, partly in section, showing the connection between the shell and wooden section.
Figure 4:
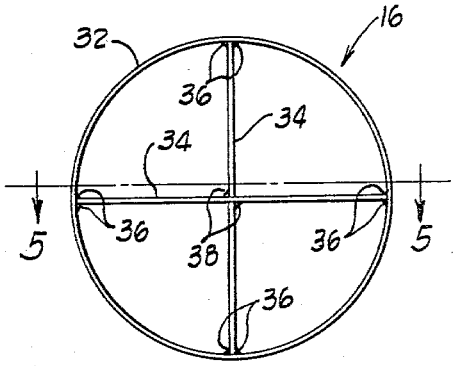
FIG. 4 is an end view of a transition fitting according to the invention.
Figure 3:
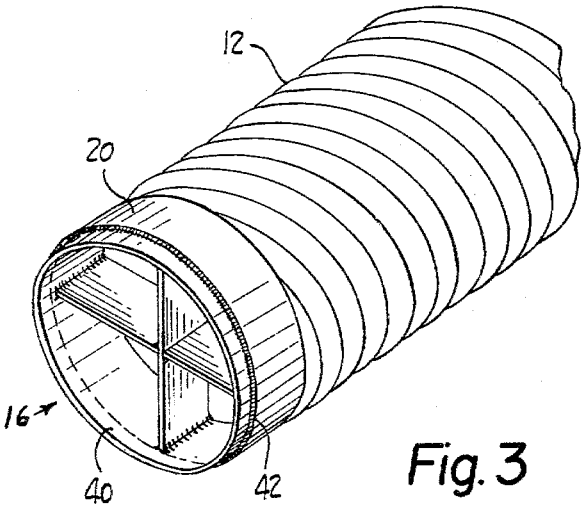
FIG. 3 is a perspective view of an assembled shell and transition fitting.

The transition fitting is secured to the end portion 20 by the weld 42 located at the interface between the transition fitting and the end of the end portion 20. It is preferred that this weld be a circumferential weld, as indicated in the FIGURES. As shown in FIG. 2, the weld is embedded in the wooden section along with the transition fitting and the end of the shell. Accordingly, any loads imposed on the shell during the driving process will have virtually no effect on the weld except to the extent there is a tensile force on the weld.

Although the invention has been described with a certain degree of particularity, it will be appreciated that the present disclosure of the preferred embodiment has been made only by way of example. Various changes in the details of construction may be resorted to without departing from the true spirit and scope of the invention, and it is intended to cover all such changes in the appended claims.

We claim:

1. A shell assembly for use in a composite pile, comprising:

(a) a unitary steel shell including a helically corrugated portion having innermost surfaces, the corrugated portion forming a major portion of the shell;

(b) the shell including an uncorrugated, tubular end portion of the uniform wall thickness integral with the corrugated portion, the inside diameter of the end portion being no greater than the diameter of an imaginary surface of revolution defined by the innermost surfaces of the shell;

(c) a transition fitting including a thin-walled ring in the shape of a solid of revolution, the ring being telescoped within the end portion;

(d) the assembly including a weld located at an interface between the transition fitting and the end portion;

(e) the ring being defined in cross section by a largely rectangular area having its longest dimension extending axially of the shell; and, (f) the fitting including a drive wedge disposed within, and secured to, the ring, the drive wedge including at least one plate-line member welded at its ends to an inner surface of the ring, the width dimension of the plate-like member lying in a plane disposed generally parallel to the longitudinal axis of the shell, the plate-like member having a surface engageable by a drive mechanism from inside the shell when the transition fitting is secured to the end portion, said engageable surface being at least in part in a plane transverse to the shell axis and between at least a major part of the corrugated portion and the weld.

2. A composite pile, comprising:

(a) an elongate, wooden pile element embedded in the ground;

(b) an elongate, tubular, helically corrugated shell having an integral, smooth-walled, tubular end portion in the form of a solid of revolution;

(c) a transition fitting having a tubular portion in telescopic relationship with the end portion, the transition fitting including at least one drive wedge extending across and fixed to at least one of the tubular portions, the wedge having a drive surface;

(d) at least part of each of the tubular portions and the drive wedge being embedded in the wooden pile near its top; and (e) a weld connecting the tubular portions together at a location such that the weld is below the drive surface and embedded in the wooden pile whereby the weld and the embedded parts of the tubular portions are embraced and frictionally engaged by the wooden pile.

3. The pile of claim 2 wherein the tubular portion of the transition fitting is telescoped within the tubular end portion of the shell and wherein the weld at least partially surrounds the tubular portion of the transition fitting at the outer end of the tubular end portion.

4. A method of making a composite pile including a helically corrugated steel shell and a wooden pile disposed beneath the shell, comprising the steps of:

(a) deforming a lower portion of the shell to convert the helical configuration in that portion of the shell to a configuration in the form of a solid of revolution of substantially uniform wall thickness;

(b) telescoping a transition fitting having a tubular steel element within the lower portion of the shell;

(c) welding the lower portion of the shell to the tubular steel element;

(d) driving a wedge element forming a part of the transition fitting at least partially into the wooden pile and with it the tubular element, the lower portion of the shell, and the connecting weld the driving being accomplished by engaging a wedge element drive surface above the weld whereby the weld is driven into the pile before any substantial portion of the shell has been embedded in the earth; and (e) continuing to drive the wedge element and the wooden pile to force the wooden pile deeper into the earth and to embed the shell into the earth to a desired depth.

5. A shell assembly for use in a composite pile, comprising:

(a) an elongated helically corrugated concrete-receiving portion forming a major portion of the shell;

(b) a tubular end portion having substantially straight walls in any plane of cross section, the end portion being integral with the concrete-receiving portion;

(c) a transition fitting fixed to the end portion in telescopic relationship;

(d) the transition fitting including a perimetral tube and a drive wedge disposed within, and secured to, the tube;

(e) the drive wedge including at least one drive member fixed to an inner wall of the tube;

(f) the drive member including a drive surface engageable by a drive mechanism from inside the shell when in use;

(g) the drive surface being disposed at least in part in a drive plane between the ends of the shell and transverse to the shell axis; and, (h) the tube and the end portion being fixed together by a weld which is on a side of said drive plane opposite at least a majority of the helical portion whereby the weld will be embedded in a wood pile when the shell assembly is in use.

6. A composite pile, comprising:

(a) an elongate, wooden pile element embedded in the ground;

(b) an elongate, tubular, helically corrugated shell having an integral, smooth-walled, tubular end portion in the form of a solid of revolution;

(c) a transition fitting having a tubular portion in telescopic relationship with the end portion;

(d) means fixing the portions together;

(e) the transition fitting including at least one drive wedge extending across and fixed to at least one of the tubular portions; the drive wedge having a drive surface above the bottoms of both portions; and (f) at least part of each of the tubular portions, the means fixing the portions together, and the drive wedge being embedded in the wooden pile near its top and being below the drive surface.

7. The composite pile of claim 6, wherein the shell has innermost surfaces and the inside diameter of the end portion is no greater than the diameter of an imaginary surface of revolution defined by the innermost surfaces of the shell.

8. The pile of claim 6 wherein the means fixing the portions together comprises a weld connecting the tubular portions together at a location such that the weld is embedded in the wooden pile.

9. The pile of claim 8 wherein the tubular portion of the transition fitting is telescoped within the tubular end portion of the shell and wherein the weld at least partially surrounds the tubular portion of the transition fitting at the outer end of the tubular end portion.

10. A shell assembly for use in a composite pile, comprising:

(a) a shell including a helically corrugated portion forming a major portion of the shell;

(b) the shell also including an uncorrugated, tubular end portion of uniform wall thickness integral with the corrugated portion;

(c) a transition fitting including an outer portion in the form of a solid of revolution secured to the end portion in a telescopic relationship, the transition fitting being secured by a weld located at an interface between the transition fitting and the end portion;

(d) the transition fitting also including a drive wedge disposed within, and secured to, the outer portion, the drive wedge including at least one plate-like member fixed at its ends to an inner surface of the outer portion, the width dimension of the plate-like member lying in a plane disposed generally parallel to the longitudinal axis of the shell, the plate-like member having a top surface engageable by a drive mechanism from inside the shell when the transition fitting is secured to the end portion;

(e) the top surface being disposed at least in part in an imaginary plane normal to the shell axis; and, (f) the weld being located on a side of the plane opposite at least a majority of the corrugated portion whereby when the assembly is part of a composite pile the weld will be embedded in a wood portion of the pile.

11. The shell assembly of claim 10 wherein the transition fitting is nested at least partially within the end portion, the outer diameter of the transition fitting being no greater than the inner diameter of the end portion.

12. The shell assembly of claim 10 or 11, wherein the shell has innermost surfaces the inside diameter of the cylindrical end portion is no greater than the diameter of an imaginary surface of revolution defined by the innermost surfaces of the shell.

* * * * *